US006533387B2

(12) United States Patent
Simmons et al.

(10) Patent No.: US 6,533,387 B2
(45) Date of Patent: Mar. 18, 2003

(54) INKJET PRINTING SYSTEM USING SINGLE MOTOR FOR PRINT MEDIA ADVANCE AND CARRIAGE MOTION

(75) Inventors: Laura Elisabeth Simmons, Corvallis, OR (US); Salvador Salcido, Jr., Albany, OR (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/832,583

(22) Filed: Apr. 11, 2001

(65) Prior Publication Data

US 2002/0149642 A1 Oct. 17, 2002

(51) Int. Cl.[7] ..... B41J 2/165

(52) U.S. Cl. ..... 347/32; 347/29; 347/30; 347/33

(58) Field of Search ..... 347/32, 29, 30, 347/22, 33, 37, 101, 104; 346/134; 400/185, 279, 323, 568, 582, 636; 271/118, 265.02, 10.13, 227

(56) References Cited

U.S. PATENT DOCUMENTS 4,920,258 A * 4/1990 Saito ..... 346/134
5,559,538 A 9/1996 Nguyen et al. ..... 347/32
5,717,443 A * 2/1998 Numata et al. ..... 347/104
5,788,383 A * 8/1998 Harada et al. ..... 400/185
5,831,644 A * 11/1998 Kato ..... 347/104
5,883,645 A * 3/1999 Ikado et al. ..... 347/30
5,106,216 A 4/1999 Kim ..... 400/185
6,318,835 B2 * 11/2001 Nakahara ..... 347/23

FOREIGN PATENT DOCUMENTS

EP 0537679 A2 4/1993
EP 0 676 291 A1 * 10/1995
EP 0916508 A2 5/1999
GB 2140746 A 12/1984

* cited by examiner

*Primary Examiner*—Shih-wen Hsieh

(57) ABSTRACT

An inkjet printing system includes a print media transport assembly which routes a print medium through the inkjet printing system, a carriage assembly which holds an inkjet printhead assembly and traverse the print medium, and a single motor operatively coupled to both the print media transport assembly and the carriage assembly. As such, the single motor selectively drives both the print media transport assembly and the carriage assembly.

30 Claims, 10 Drawing Sheets

INKJET PRINTING SYSTEM USING SINGLE MOTOR FOR PRINT MEDIA ADVANCE AND CARRIAGE MOTION

THE FIELD OF THE INVENTION

The present invention relates generally to inkjet printers, and more particularly to an inkjet printing system using a single motor for print media advance and carriage motion.

BACKGROUND OF THE INVENTION

A conventional inkjet printing system includes a printhead and an ink supply which supplies liquid ink to the printhead. The printhead, commonly referred to as a pen, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

As illustrated in FIG. 1, a conventional inkjet printing system 200 includes a print media transport assembly 210 which moves and/or routes the print medium through a print media path, a carriage assembly 220 which moves the printhead relative to the print medium, and a service station assembly 230 which maintains functionality of the printhead. The print media transport assembly typically includes a paper pick-up assembly 212 which brings the print medium into the printing system, a drive or feed roller assembly 214 which advances the print medium through the printing system, and a paper path motor 216 which operates the paper pick-up assembly and the feed roller assembly. The carriage assembly typically includes a carriage 222 which carries the printhead and a carriage motor 224 which operates the carriage. Furthermore, the service station assembly typically includes a service station motor 232 which operates functions of the service station assembly.

FIG. 2 illustrates a method 300 of operation of the conventional inkjet printing system. At step 302, the inkjet printing system gains operational control of a print job. Next, at step 304, the printhead is uncapped and wiped by operation of the service station assembly. Operation of the service station assembly in step 304 requires operation of the service station motor. Next, at step 306, the print medium is pulled into the printing system by operation of the print media transport assembly. Operation of the print media transport assembly in step 306 requires operation of the paper path motor. Next, at step 308, the carriage is moved to a "Ready" position by operation of the carriage assembly. Operation of the carriage assembly in step 308 requires operation of the carriage motor.

To begin printing the print job, the print medium is moved into position by operation of the print media transport assembly at step 310. Operation of the print media transport assembly in step 310 requires operation of the paper path motor. Next, at step 312, the carriage is moved across the print medium by operation of the carriage assembly to print a print swath. Operation of the carriage assembly in step 312 requires operation of the carriage motor. As such, steps 310 and 312 are repeated until the print job is completed.

Once the print job is completed, the print medium is kicked from the printing system by operation of the print media transport assembly at step 314. Operation of the print media transport assembly in step 314 requires operation of the paper path motor. Next, at step 316, the carriage is moved to a "Rest" position by operation of the carriage assembly. Operation of the carriage assembly in step 316 requires operation of the carriage motor. Finally, at step 318, the printhead is wiped and capped by operation of the service station assembly. Operation of the service station assembly in step 318 requires operation of the service station motor.

Operation of the conventional inkjet printing system, therefore, requires operation of three separate motors. More specifically, operation of the conventional inkjet printing system requires operation of a paper path motor, a carriage motor, and a service station motor. Unfortunately, the requirement of three motors adds to the size, complexity, and cost of the conventional inkjet printing system.

Accordingly, a need exists for an inkjet printing system which is smaller or performs more functions for the same size, simpler to manufacture, and/or less expensive to manufacture. In particular, a need exits for an inkjet printing system which utilizes a single motor to control operation of multiple printing functions such as moving a print carriage, advancing a print medium, and/or maintaining a printhead.

SUMMARY OF THE INVENTION

One aspect of the present invention provides an inkjet printing system. The inkjet printing system includes a print media transport assembly adapted to route a print medium through the inkjet printing system, a carriage assembly adapted to hold an inkjet printhead assembly and traverse the print medium, and a motor operatively coupled to both the print media transport assembly and the carriage assembly. As such, the motor is adapted to drive both the print media transport assembly and the carriage assembly.

In one embodiment, the motor is configured to sequentially operate the print media transport assembly and the carriage assembly.

In one embodiment, the motor is adapted to advance the print medium and move the inkjet printhead assembly. In one embodiment, the motor is adapted to advance the print medium in a first direction and move the inkjet printhead assembly in a second direction, wherein the second direction is substantially perpendicular to the first direction. In one embodiment, the motor is configured to rotate a portion of the print media transport assembly in the first direction and reciprocate a portion of the carriage assembly in the second direction.

In one embodiment, the print media transport assembly includes a first shaft and at least one roller mounted on the first shaft, and the carriage assembly includes a second shaft and a carriage slidably mounted on the second shaft. As such, the at least one roller is adapted to contact the print medium and the carriage is adapted to carry the inkjet printhead assembly.

In one embodiment, the inkjet printing system further includes a service station assembly adapted to at least one of wipe, cap, and uncap the inkjet printhead assembly. As such, the motor is operatively coupled to and adapted to drive each of the print media transport assembly, the carriage assembly, and the service station assembly.

In one embodiment, the inkjet printing system includes a first power transmission path defined between the motor and the carriage assembly, and a second power transmission path defined between the motor and the print media transport assembly. As such, the motor is operatively coupled to the carriage assembly via the first power transmission path and operatively coupled to the print media transport assembly via the second power transmission path.

In one embodiment, the inkjet printing system includes a third power transmission path defined between the motor and a service station assembly of the inkjet printing system. As such, the motor is operatively coupled to the service station assembly via the third power transmission path. In one embodiment, the third power transmission path includes the second power transmission path.

In one embodiment, the inkjet printing system includes a first power transmission arrangement interposed between the motor and the carriage assembly. The first power transmission arrangement includes a first coupling configured to selectively connect and disconnect the motor with the carriage assembly. In one embodiment, the first power transmission arrangement further includes a power transmission element configured to transfer rotational power of the motor to a reciprocatable element of the carriage assembly.

In one embodiment, the inkjet printing system includes a second power transmission arrangement interposed between the motor and the print media transport assembly. The second power transmission arrangement includes a second coupling configured to selectively connect and disconnect the motor with the print media transport assembly. In one embodiment, the second power transmission arrangement further includes a gear train configured to transfer rotational power of the motor to a rotatable shaft of the print media transport assembly.

In one embodiment, the inkjet printing system includes a third power transmission arrangement interposed between the motor and a service station assembly of the inkjet printing system. The third power transmission arrangement includes a third coupling configured to selectively connect and disconnect the motor with the service station assembly. In one embodiment, the third power transmission arrangement further includes a gear train configured to transfer rotational power of the motor to a movable pallet of the service station assembly.

In one embodiment, the inkjet printing system further includes a first sensor adapted to detect a position of the inkjet printhead assembly and generate a first position signal in response thereto, a second sensor adapted to detect a position of the print medium and generate a second position signal in response thereto, and an electronic controller adapted to receive the first position signal and the second position signal. As such, the electronic controller is adapted to control at least one of coupling and operation of the motor in response to at least one of the first position signal and the second position signal.

Another aspect of the present invention provides a method of printing on a print medium with an inkjet printing system including an inkjet printhead assembly. The method includes routing the print medium through the inkjet printing system via a print media transport assembly and traversing the print medium with the inkjet printhead assembly via a carriage assembly. As such, the steps of routing the print medium and traversing the print medium include operatively coupling and driving both the print media transport assembly and the carriage assembly with a single motor.

The present invention provides an inkjet printing system which utilizes a single motor to control operation of multiple printing functions. As such, the single motor controls operation of a carriage assembly of the inkjet printing system and a print media transport assembly of the inkjet printing system. In addition, the single motor also controls operation of a service station assembly of the inkjet printing system.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "right," "left," "forward," "reverse," etc., is used with reference to the orientation of the Figure(s) being described. The inkjet printing system and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
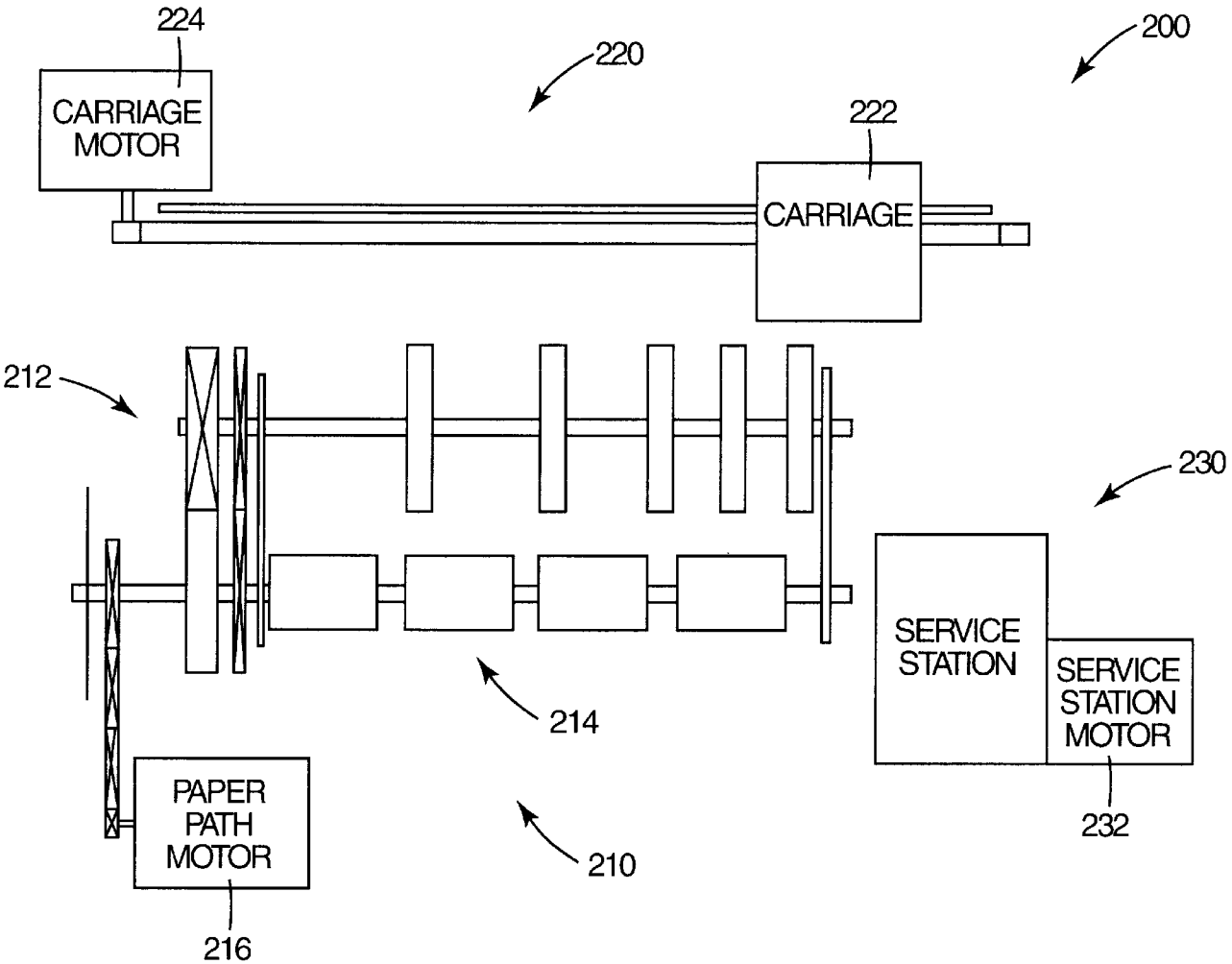
Fig. 1 PRIOR ART
FIG. 1 is schematic illustration of a portion of a prior art inkjet printing system.
Figure 2:
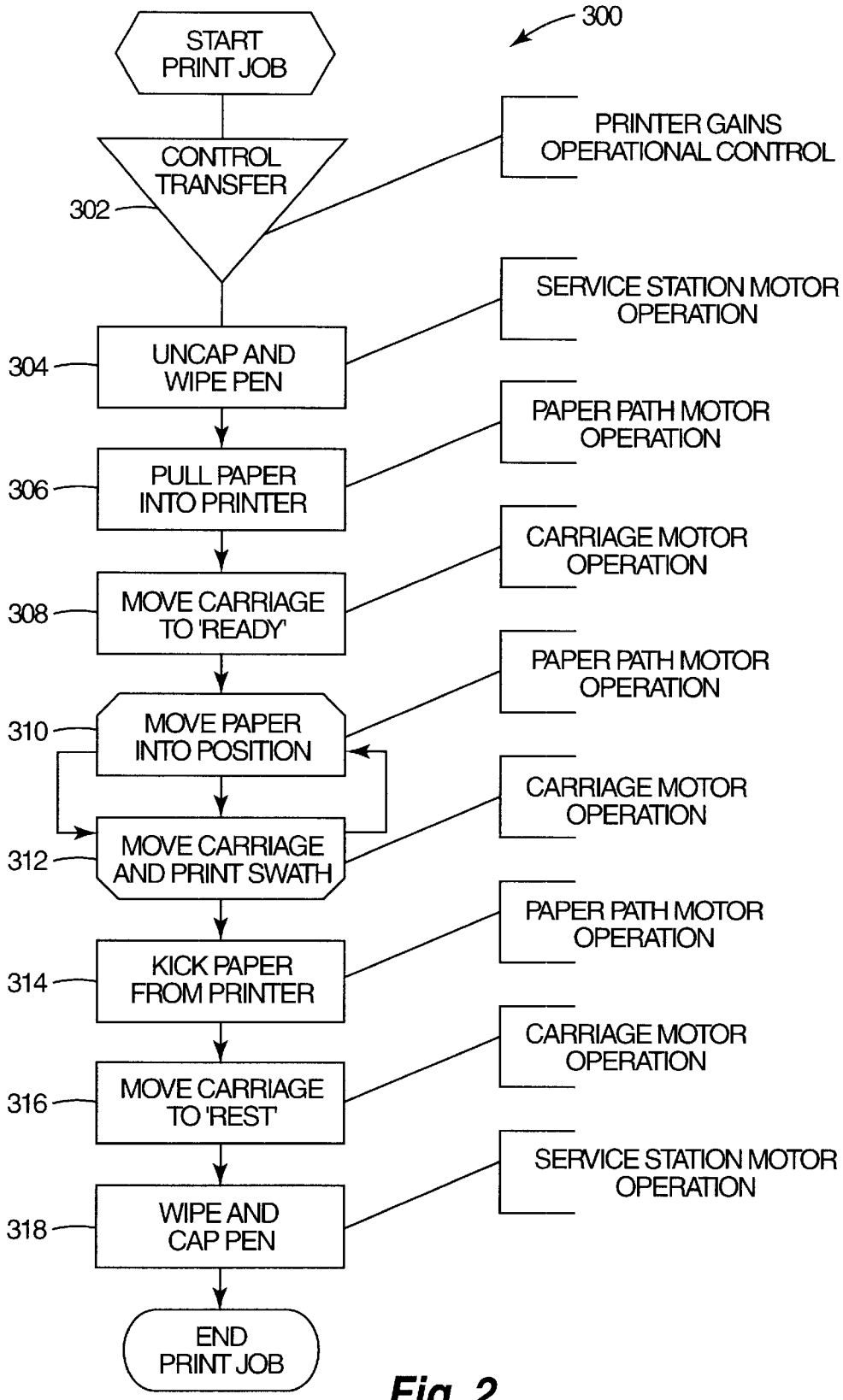
Fig. 2 PRIOR ART
FIG. 2 is a flow diagram illustrating one embodiment of a method of operating the prior art inkjet printing system of FIG. 1.
Figure 3:
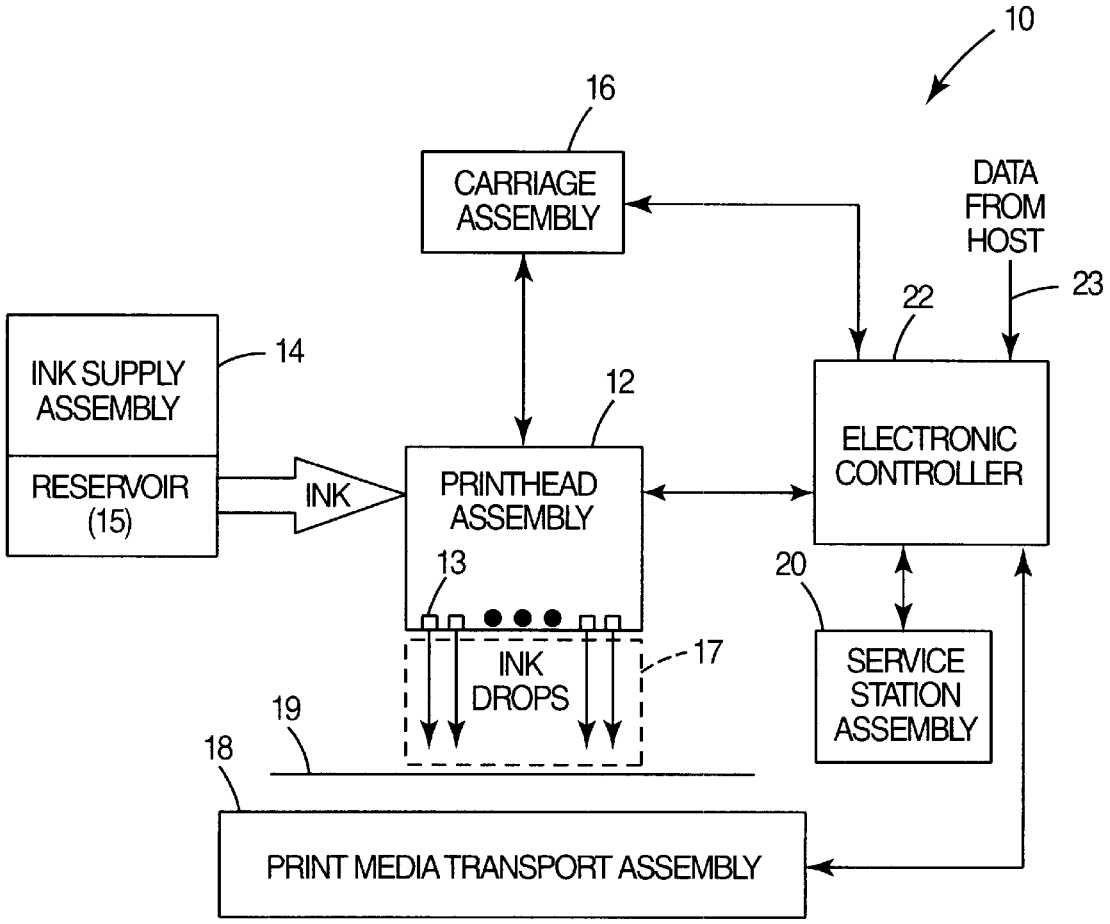
FIG. 3 is a block diagram illustrating one embodiment of an inkjet printing system according to the present invention.

FIG. 3 illustrates one embodiment of an inkjet printing system 10 according to the present invention. Inkjet printing system 10 includes an inkjet printhead assembly 12, an ink supply assembly 14, a carriage assembly 16, a print media transport assembly 18, a service station assembly 20, and an electronic controller 22. Inkjet printhead assembly 12 includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, cloth, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to inkjet printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Carriage assembly 16 positions inkjet printhead assembly 12 relative to print media transport assembly 18 and print media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, carriage assembly 16 moves inkjet printhead assembly 12 relative to print media transport assembly 18 to scan print medium 19.

Service station assembly 20 provides for spitting, wiping, capping, and/or priming of inkjet print assembly 12 in order to maintain a functionality of inkjet printhead assembly and, more specifically, nozzles 13. In one embodiment, service station assembly 70 includes a spittoon into which inkjet printhead assembly 12 ejects ink to insure that reservoir 15 maintains an appropriate level of pressure and fluidity and that nozzles 13 do not clog or weep. In addition, service station assembly 20 includes a rubber blade or wiper which is periodically passed over inkjet printhead assembly 12 to wipe and clean nozzles 13 of excess ink. Service station assembly 20 also includes a cap which covers inkjet printhead assembly 12 to protect nozzles 13 from drying out during periods of non-use. Functions of service station assembly 20, therefore, require relative motion between service station assembly 20 and inkjet printhead assembly 12.

Electronic controller 22 communicates with inkjet printhead assembly 12, carriage assembly 16, print media transport assembly 18, and service station assembly 20. Electronic controller 22 receives data 23 from a host system, such as a computer, and includes memory for temporarily storing data 23. Typically, data 23 is sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one embodiment, electronic controller 22 provides control of inkjet printhead assembly 12 including timing control for ejection of ink drops from nozzles 13. As such, electronic controller 22 defines a pattern of ejected ink drops which form characters, symbols, and/or other graphics or images on print medium 19. Timing control and, therefore, the pattern of ejected ink drops, is determined by the print job commands and/or command parameters.

Figure 4:
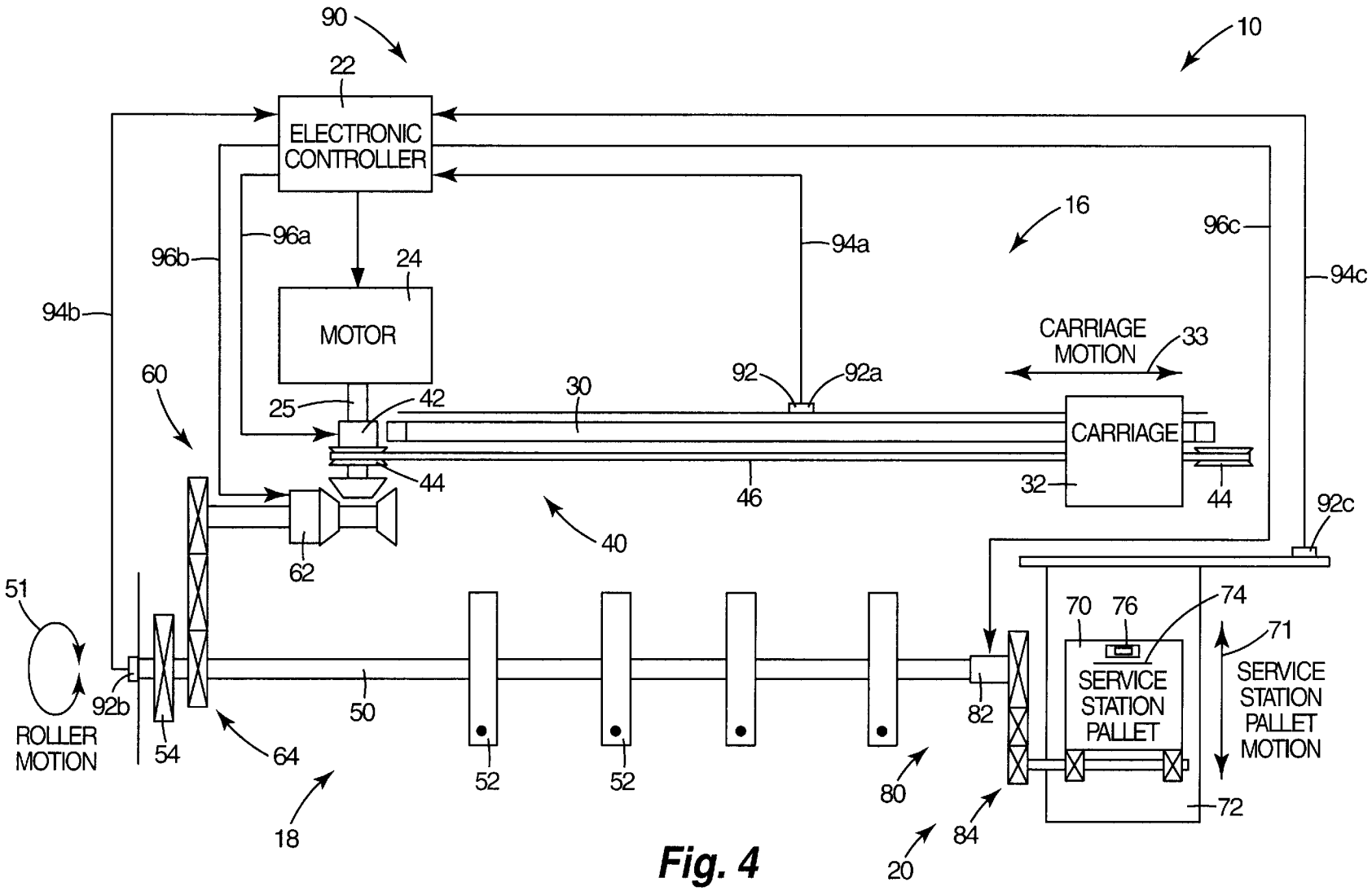
FIG. 4 is a schematic illustration of a portion of an inkjet printing system in a first mode of operation according to the present invention.

Referring to FIG. 4, inkjet printing system 10 includes a single drive motor 24. Motor 24 is operatively coupled with carriage assembly 16, print media transport assembly 18, and service station assembly 20. As such, motor 24 operates, drives, or powers each of carriage assembly 16, print media transport assembly 18, and service station assembly 20. Thus, power from drive motor 24 is selectively transmitted to each of carriage assembly 16, print media transport assembly 18, and service station assembly 20, as described in detail below. Motor 24, therefore, includes an output 25 which is selectively coupled with each of carriage assembly 16, print media transport assembly 18, and service station assembly 20.

In one embodiment, carriage assembly 16 includes a shaft 30 and a carriage 32. Shaft 30 is mounted in a housing (not shown) of inkjet printing system and provides a guide for carriage 32. Carriage 32 carries inkjet printhead assembly 12 and is slidably mounted on shaft 30 for lateral movement, as indicated by bi-directional arrow 33. As such, carriage 32 moves inkjet printhead assembly 12 back and forth across print medium 19.

To transfer power of motor 24 to carriage assembly 16, a power transmission arrangement 40 is interposed between motor 24 and carriage assembly 16. In one embodiment, power transmission arrangement 40 includes a coupling 42, such as a clutch, to selectively connect and disconnect output 25 of motor 24 with carriage assembly 16. In addition, power transmission arrangement 40 includes a power transmission element 44, such as a pulley or gear, to transfer rotational power of motor 24 to a reciprocating element 46, such as a belt or chain, coupled with carriage 32. As such, coupling 42 selectively connects and disconnects power transmission element 44 with output 25 of motor 24. Thus, power of motor 24 is transferred to power transmission element 44 and reciprocating element 46 when coupling 42 is engaged. Reciprocating element 46, therefore, imparts lateral motion to carriage 32.

In one embodiment, print media transport assembly 18 includes a shaft 50 and one or more rollers 52. Shaft 50 is mounted in a housing (not shown) of inkjet printing system 10 for rotational movement, as indicated by bi-directional arrow 51. Rollers 52 are mounted on shaft 50 to contact and route print medium 19 through a print media path of inkjet printing system 10. As such, rollers 52 advance print medium 19 relative to carriage 32 in a direction substantially perpendicular to the direction of motion of carriage 32. Print media transport assembly 18 also includes a paper pick-up mechanism 54 which initially engages a top sheet of print medium 19 and routes print medium 19 to rollers 52. Motion is imparted to paper pick-up mechanism 54 via shaft 50.

To transfer power of motor 24 to print media transport assembly 18, a power transmission arrangement 60 is interposed between motor 24 and print media transport assembly 18. In one embodiment, power transmission arrangement 60 includes a coupling 62, such as a clutch, to selectively connect and disconnect output 25 of motor 24 with print media transport assembly 18. In addition, power transmission arrangement 60 includes a gear train 64 which transfers rotational power of motor 24 to shaft 50 of print media transport assembly 18. As such, coupling 62 selectively connects and disconnects gear train 64 with output 25 of motor 24. Thus, power of motor 24 is transferred to gear train 64 when coupling 62 is engaged. Gear train 64, therefore, imparts rotational motion to shaft 50 and rollers 52.

In one embodiment, service station assembly 20 includes a service station pallet 70 and a chassis 72. Service station pallet 70 is mounted in chassis 72 for movement, as indicated by bi-directional arrow 71. Service station pallet 70 carries, for example, one or more wipers 74 which pass over inkjet printhead assembly 12 to clean and/or remove excess ink from a face of inkjet printhead assembly 12 and at least one cap 76 which covers inkjet printhead assembly 12 when not in use to prevent inkjet printhead assembly 12 from drying out. Wiping and capping of inkjet printhead assembly 12, therefore, requires motion of service station assembly 20 and, more specifically, motion of service station pallet 70 relative to inkjet printhead assembly 12. Configuration and operation of service station assembly 20 is described, for example, in U.S. patent application Ser. No. 09/715,628, entitled "A Service Station for Printers Having Firing Nozzles Perpendicular to Direction of Carriage Motion" assigned to the assignee of the present invention and incorporated herein by reference.

To transfer power of motor 24 to service station assembly 20, a power transmission arrangement 80 is interposed between motor 24 and service station assembly 20. In one embodiment, power transmission arrangement 80 includes a coupling 82, such as a clutch, to selectively connect and disconnect output 25 of motor 24 with service station assembly. In addition, power transmission arrangement 80 includes a gear train 84 which transfers rotational power of motor 24 to service station pallet 70. As such, coupling 82 selectively connects and disconnects gear train 84 with output 25 of motor 24. Thus, power of motor 24 is transferred to gear train 84 when coupling 82 is engaged. Gear train 84, therefore, imparts motion to service station pallet 70.

In one embodiment, inkjet printing system 10 includes an electronic control system 90. Electronic control system 90 includes electronic controller 22 which receives print job commands and/or command parameters, as described above. As such, electronic controller 22 controls operation of motor 24 and power transmission arrangements 40, 60, and 80 to selectively provide power to carriage assembly 16, print media transport assembly 18, and service station assembly 20, respectively, as described below.

In one embodiment, electronic control system 90 includes a plurality of positional sensors 92. Positional sensors 92 include, for example, a sensor 92*a* which detects a linear position of carriage 32, including inkjet printhead assembly 12, a sensor 92*b* which detects a rotational position of shaft 50 and/or rollers 52, and a sensor 92*c* which detects a position of service station pallet 70. As such, positional sensors 92*a*, 92*b*, and 92*c* transmit signals representing a position of carriage 32, a position of shaft 50 and/or rollers 52, and a position of service station pallet 70 to electronic controller 22 via signal lines 94*a*, 94*b*, and 94*c*, respectively. Sensor 92*a* includes, for example, a linear encoder to sense the linear position of carriage 32 and sensor 92*b* includes, for example, a rotational encoder to sense the rotational position of shaft 50 and/or rollers 52. The position of carriage 32, therefore, represents a position of inkjet printhead assembly 12 and the position of shaft 50 and/or rollers 52 correlates to a position of print medium 19.

To control operation of power transmission arrangements 40, 60, and 80, electronic controller 22 sends control signals to couplings 42, 62, and 82 via control signal lines 96*a*, 96*b*, and 96*c*, respectively. As such, electronic controller 22 selectively engages and/or disengages couplings 42, 62, and 82 to connect and/or disconnect output 25 of motor 24 with carriage assembly 16, print media transport assembly 18, and/or service station assembly 20, respectively. It is understood, however, that engagement and/or disengagement of couplings 42, 62, and/or 82 may be activated and/or de-activated by motions within inkjet printing system 10. For example, coupling 62 of power transmission arrangement 60 may be activated by motion of carriage 32 and/or coupling 82 of power transmission arrangement 80 may be de-activated by motion of service station pallet 70.

FIGS. 4–9 illustrate one embodiment of a method of operation of inkjet printing system 10 according to the present invention. FIG. 4 illustrates inkjet printing system 10 in a "Rest" mode of operation awaiting a print job. As such, carriage 32 of carriage assembly 16 is parked or positioned over service station assembly 20 such that inkjet printhead assembly 12 is capped by cap 76 of service station assembly 20. In addition, couplings 42 and 62 of power transmission arrangements 40 and 60, respectively, are disengaged. Thus, carriage assembly 16 and print media transport assembly 18, including, paper pick-up mechanism 54, are disengaged. Moreover, motor 24 is idle. As such, no motion is imparted to carriage assembly 16, print media transport assembly 18, or service station assembly 20.

Figure 5:
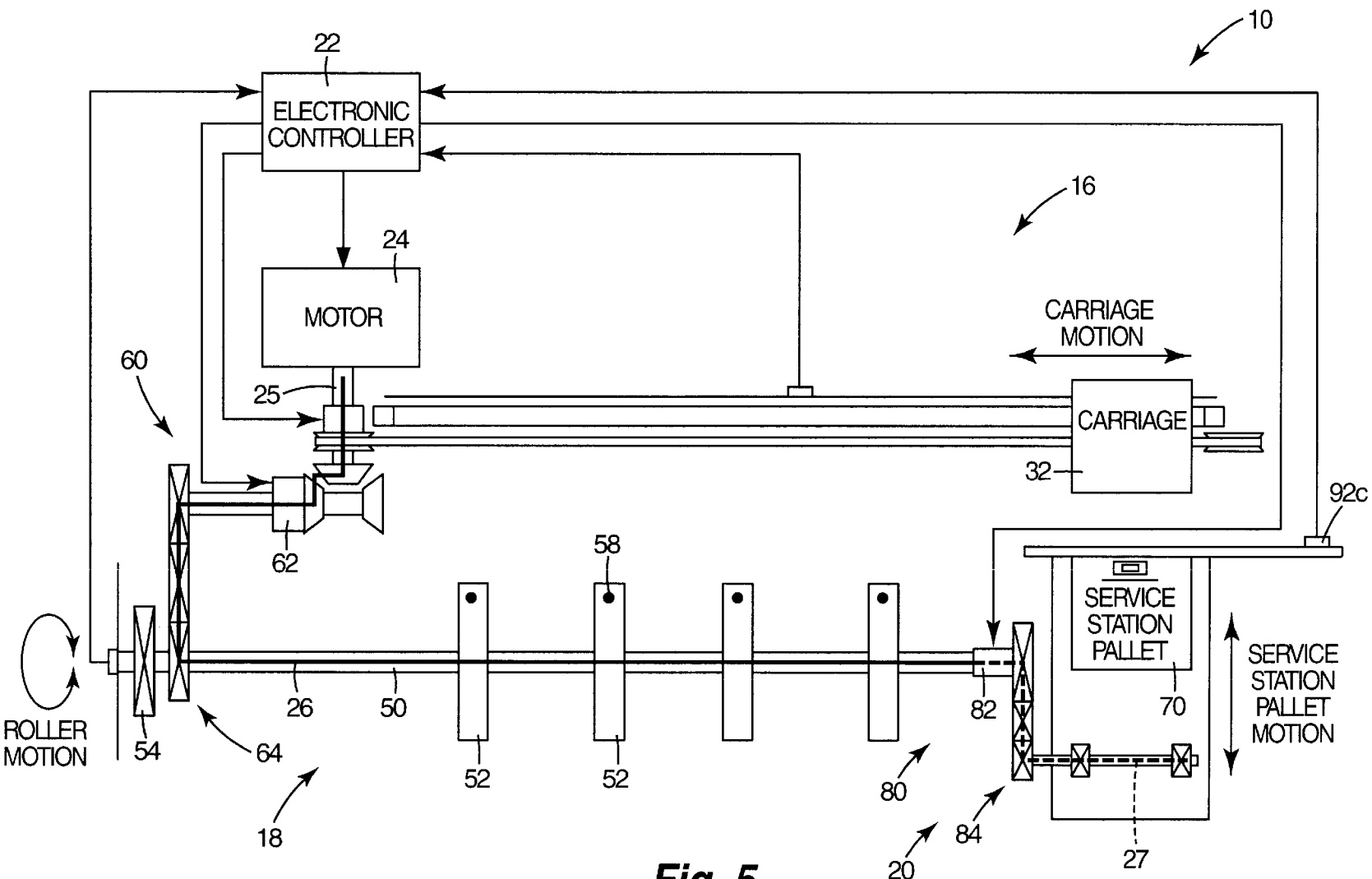
FIG. 5 is a schematic illustration of the inkjet printing system of FIG. 4 in a second mode of operation according to the present invention.

FIG. 5 illustrates inkjet printing system 10 in a "Ready" mode of operation in response to receiving a command for a print job. As such, carriage 32 remains positioned over service station assembly 20. Couplings 62 and 82 of power transmission arrangements 60 and 80, respectively, however, are engaged and motor 24 is operated.

With couplings 62 and 82 engaged, a power transmission path, as indicated by solid line 26 and dashed-line 27, is defined between motor 24 and service station assembly 20. Thus, the power transmission path includes a power transmission path defined between motor 24 and print media transport assembly 18. Rotational power of output 25 of motor 24, therefore, is transferred through coupling 62, gear train 64, shaft 50, coupling 82, and gear train 84. As such, shaft 50 is rotated in a forward direction, as indicated by dots 58, and gear train 84 is operated. Thus, operation of gear train 84 moves service station pallet 70 such that inkjet printhead assembly 12 is uncapped from cap 76 and wiped by wiper 74 of service station assembly 20.

In one embodiment, electronic control system 90 initiates the "Ready" mode of operation of inkjet printing system 10. As such, electronic controller 22 engages couplings 62 and 82 of power transmission arrangements 60 and 80, respectively. Thus, the power transmission path, as indicated by solid line 26 and dashed-line 27, is defined between motor 24 and service station assembly 20. Service station assembly 20, therefore, moves service station pallet 70, as described above.

In one embodiment, sensor 92*c* of electronic control system 90 senses the motion of service station pallet 70 and initiates completion of the "Ready" mode of operation of inkjet printing system 10. As such, after service station pallet 70 has moved, electronic controller 22 disengages coupling 82 of power transmission arrangement 80 and paper pick-up mechanism 54 is activated. Thus, the power transmission path is confined to solid line 26. Paper pick-up mechanism 54, therefore, engages a top sheet of print medium 19 and routes print medium 19 to rollers 52 of print media transport assembly 18. In one embodiment, paper pick-up mechanism 54 is automatically deactivated by print medium 19 entering inkjet printing system 10.

Figure 6:
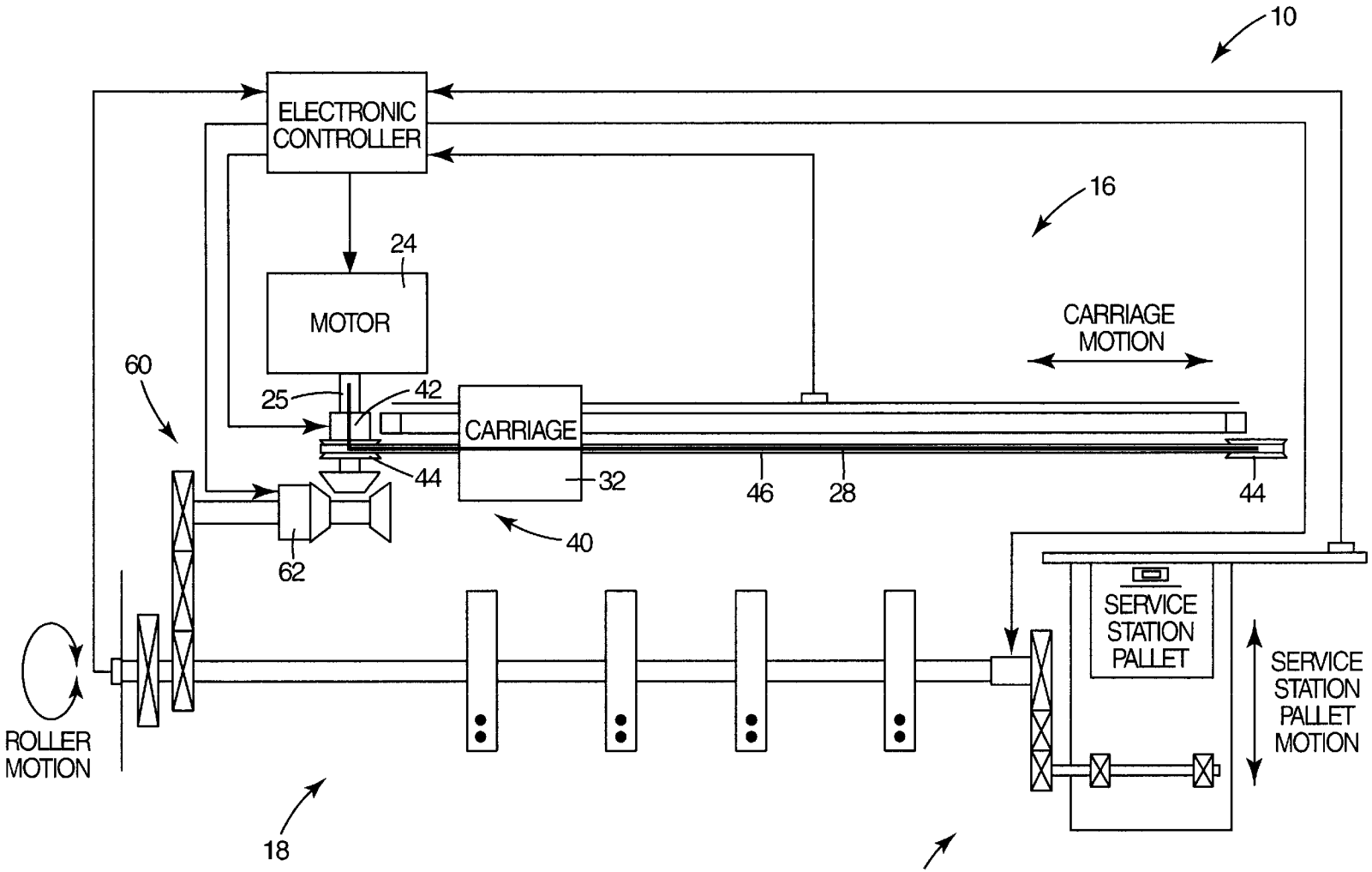
FIG. 6 is a schematic illustration of the inkjet printing system of FIG. 4 in a first phase of a third mode of operation according to the present invention.

FIG. 6 illustrates inkjet printing system 10 in one phase, "Right-to-Left Print Swath" phase, of a "Print" mode of operation while printing a print job. As such, coupling 62 of power transmission arrangement 60 is disengaged, coupling 42 of power transmission arrangement 40 is engaged, and motor 24 is operated.

With coupling 62 disengaged and coupling 42 engaged, a power transmission path, as indicated by solid line 28, is defined between motor 24 and carriage assembly 16. Rotational power of output 25 of motor 24, therefore, is transferred through coupling 42, power transmission element 44, and reciprocating element 46. As such, reciprocating element 46 is moved laterally right to left. Thus, movement of reciprocating element 46 moves carriage 32 across print medium 19 right to left. As carriage 32 moves across print medium 19, inkjet printhead assembly 12 creates a print swath on print medium 19. It is understood, however, that carriage 32 may move across print medium 19 without any printing by inkjet printhead assembly 12.

Figure 7:
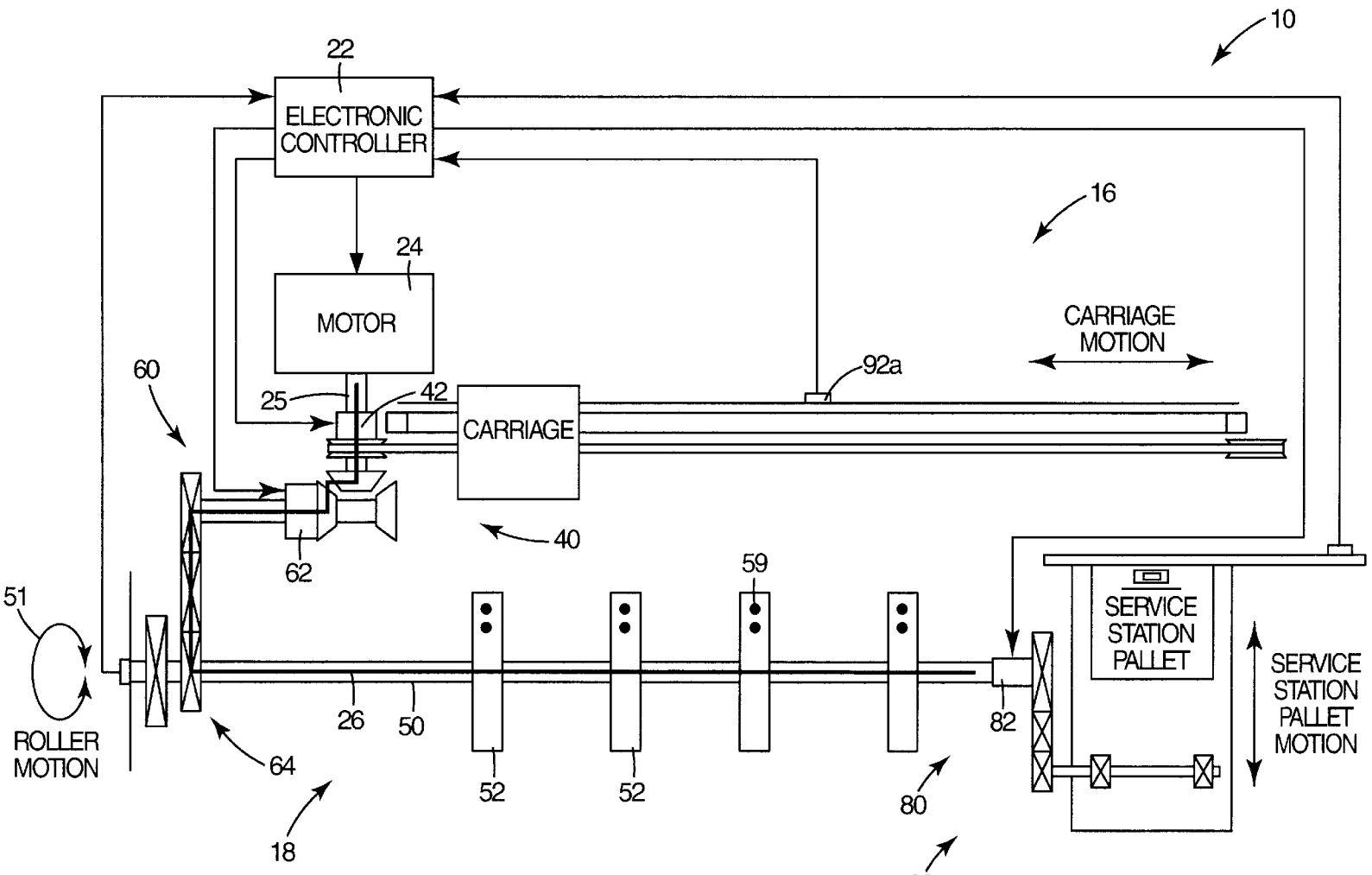
FIG. 7 is a schematic illustration of the inkjet printing system of FIG. 4 in a second phase of the third mode of operation according to the present invention.

FIG. 7 illustrates inkjet printing system 10 in another phase, "Paper Advance" phase, of the "Print" mode of operation while printing a print job. As such, coupling 42 of power transmission arrangement 40 is disengaged and coupling 62 of power transmission arrangement 60 is engaged while coupling 82 of power transmission arrangement 80 remains disengaged and motor 24 is operated.

With coupling 42 disengaged, coupling 62 engaged, and coupling 82 disengaged, a power transmission path, as indicated by solid line 26, is defined between motor 24 and print media transport assembly 18. Rotational power of output 25 of motor 24, therefore, is transferred through coupling 62, gear train 64, shaft 50, and rollers 52. As such, shaft 50 and, therefore, rollers 52 are rotated in a forward direction, as indicated by double dots 59. Thus, rotation of rollers 52 advances print medium 19 through a print media path of inkjet printing system 10.

In one embodiment, sensor 92*a* of electronic control system 90 senses the motion of carriage assembly 16 and initiates the "Paper Advance" phase of the "Print" mode of operation of inkjet printing system 10. As such, when carriage 32 reaches the end of a lateral pass, electronic controller 22 disengages coupling 42 of power transmission arrangement 40 and engages coupling 62 of power transmission arrangement 60. Thus, the power transmission path, as indicated by solid line 26, is defined between motor 24 and print media transport assembly 18. Print media transport assembly 18, therefore, advances print medium 19, as described above.

Figure 8:
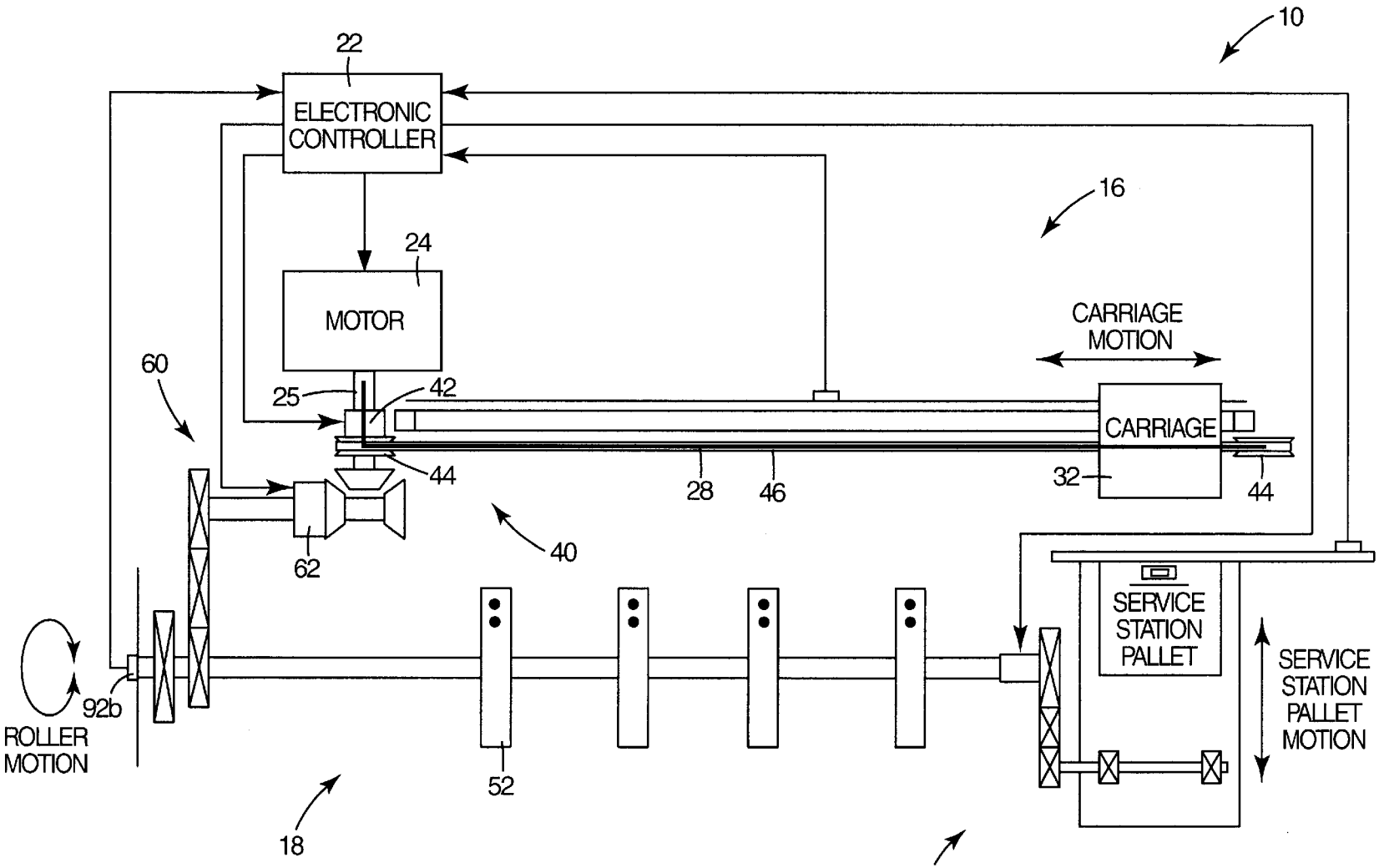
FIG. 8 is a schematic illustration of the inkjet printing system of FIG. 4 in a third phase of the third mode of operation according to the present invention.

FIG. 8 illustrates inkjet printing system 10 in another phase, "Left-to-Right Print Swath" phase, of the "Print" mode of operation while printing a print job. As such, coupling 62 of power transmission arrangement 60 is disengaged, coupling 42 of power transmission arrangement 40 is engaged, and motor 24 is operated.

With coupling 62 disengaged and coupling 42 engaged, a power transmission path, as indicated by solid line 28, is defined between motor 24 and carriage assembly 16. Rotational power of output 25 of motor 24, therefore, is transferred through coupling 42, power transmission element 44, and reciprocating element 46. As such, reciprocating element 46 is moved laterally left to right. Thus, movement of reciprocating element 46 moves carriage 32 across print medium 19 left to right. As carriage 32 moves across print medium 19, inkjet printhead assembly 12 creates another print swath on print medium 19.

In one embodiment, sensor 92*b* of electronic control system 90 senses the motion of print media transport assembly 18 and initiates the "Left-to-Right Print Swath" phase of the "Print" mode of operation of inkjet printing system 10. As such, when rollers 52 have advanced print medium 19 a predetermined amount, the electronic controller 22 disengages coupling 62 of power transmission arrangement 60 and engages coupling 42 of power transmission arrangement 40. Thus, the power transmission path, as indicated by solid line 28, is defined between motor 24 and carriage assembly 16. Carriage assembly 16, therefore, moves carriage 32, as described above.

To complete a print job, inkjet printing system 10 cycles through the phases of the "Print" mode of operation. More specifically, inkjet printing system 10 repeats the "Right-to-Left Print Swath" phase, the "Paper Advance" phase, the "Left-to-Right Print Swath" phase, the "Paper Advance" phase, the "Right-to-Left Print Swath" phase, etc., until the print job is completed.

Figure 9:
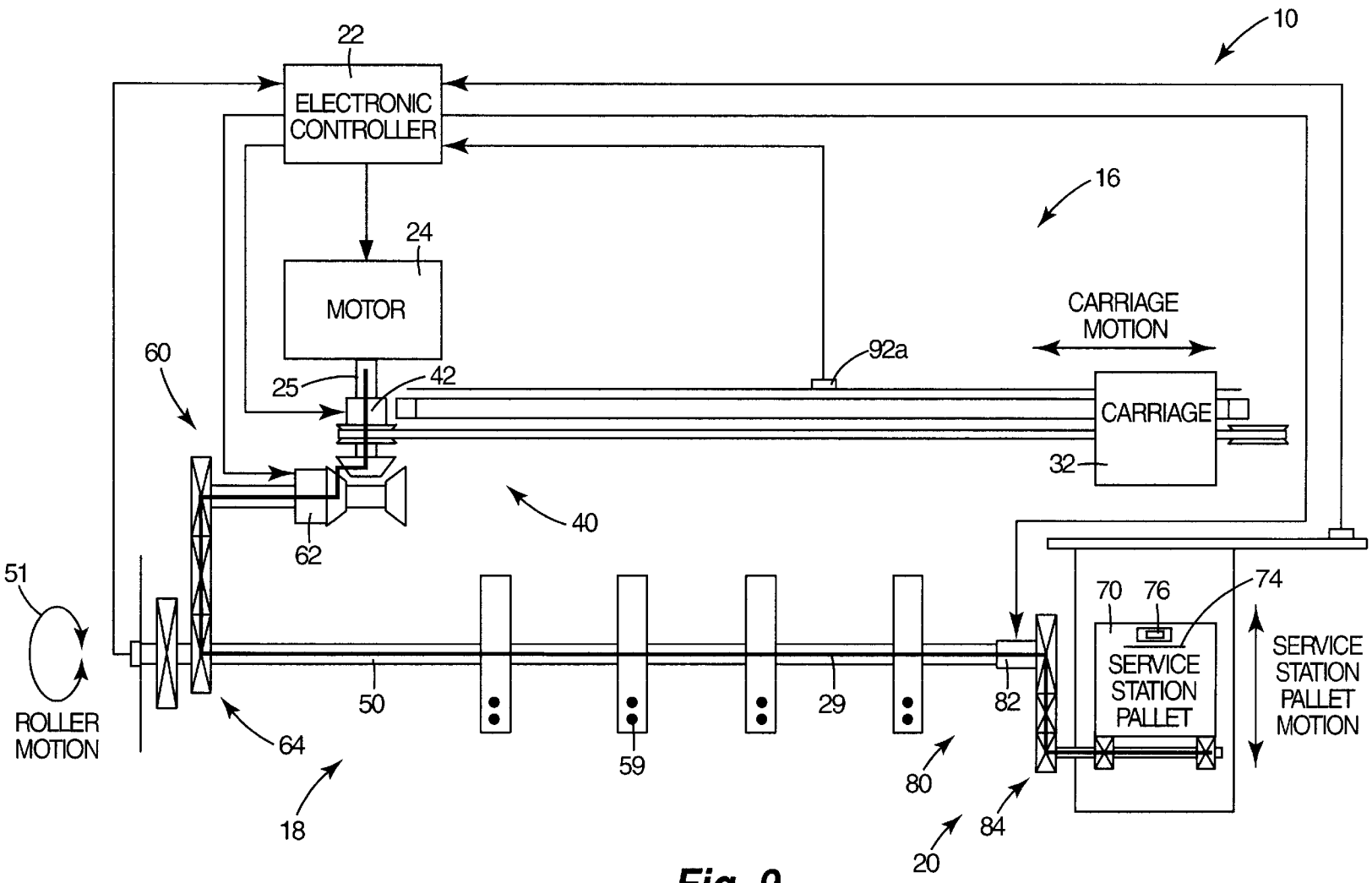
FIG. 9 is a schematic illustration of the inkjet printing system of FIG. 4 in a fourth mode of operation according to the present invention.

FIG. 9 illustrates inkjet printing system 10 in a "Return-to-Rest" mode of operation after completing a print job. As such, carriage 32 is parked or positioned over service station assembly 20. In addition, coupling 42 of power transmission arrangement 40 is disengaged, couplings 62 and 82 of power transmission arrangements 60 and 80, respectively, are engaged, and motor 24 is operated.

With coupling 42 disengaged, and couplings 62 and 82 engaged, a power transmission path, as indicated by solid line 29, is defined between motor 24 and service station assembly 20. Rotational power of output 25 of motor 24, therefore, is transferred through coupling 62, gear train 64, shaft 50, coupling 82, and gear train 84. As such, shaft 50 is rotated in a reverse direction, as indicated by double dots 59, and gear train 84 is operated. Thus, operation of gear train 84 moves service station pallet 70 such that inkjet printhead assembly 12 is wiped by wiper 74 and capped by cap 76 of service station assembly 20.

In one embodiment, sensor 92*a* of electronic control system 90 senses the motion of carriage assembly 16 and initiates the "Return-to-Rest" mode of operation of inkjet printing system 10. As such, when carriage 32 reaches the end of a final lateral pass, electronic controller 22 disengages coupling 42 of power transmission arrangement 40 and engages couplings 62 and 82 of power transmission arrangements 60 and 80, respectively. Thus, the power transmission path, as indicated by solid line 29, is defined between motor 24 and service station assembly 20. Service station assembly 20, therefore, wipes and caps inkjet printhead assembly 12, as described above.

Figure 10:
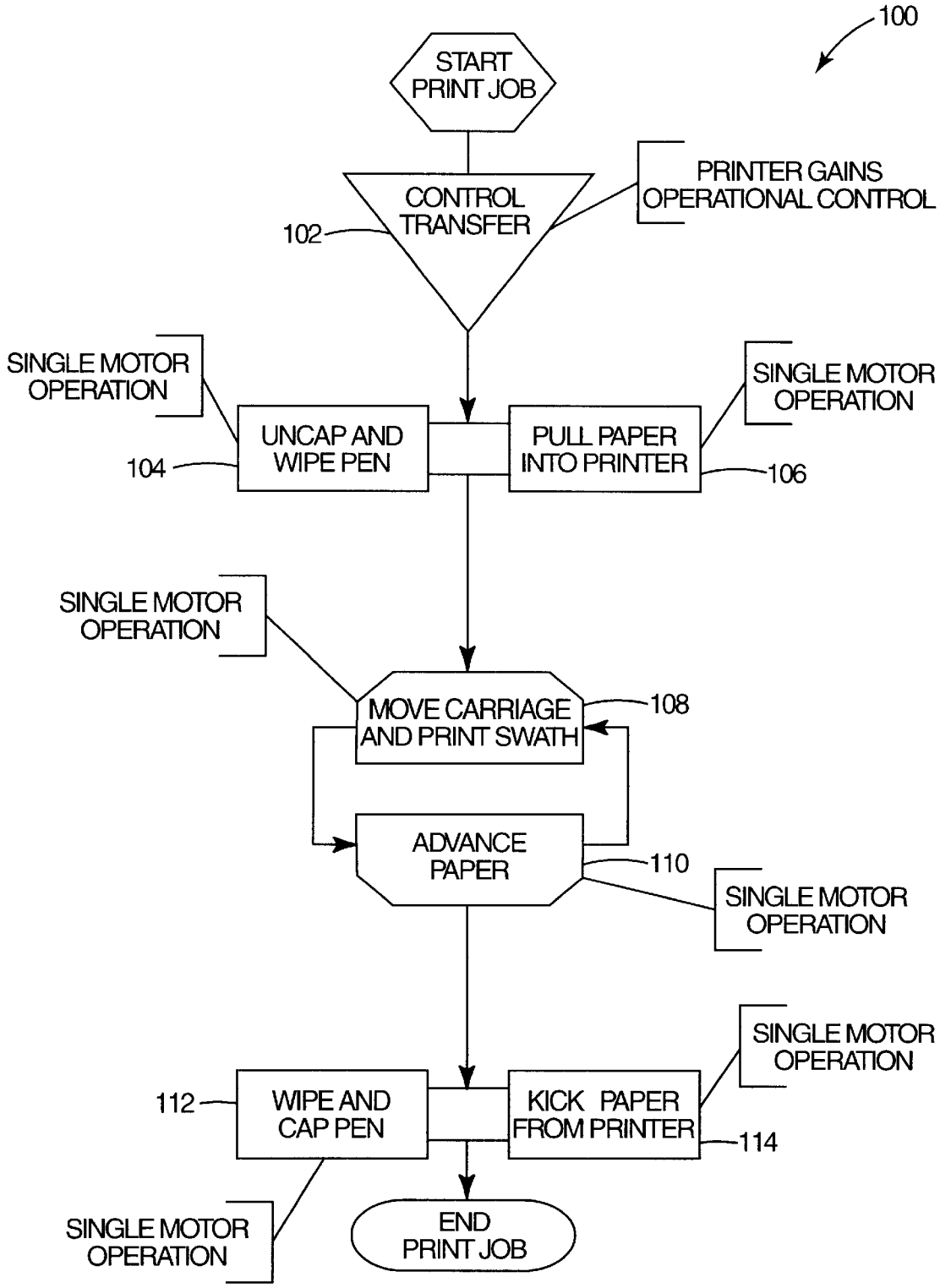
FIG. 10 is a flow diagram illustrating one embodiment of a method of operating an inkjet printing system according to the present invention.

FIG. 10 illustrates one embodiment of a method 100 of operating inkjet printing system 10 according to the present invention. Initially, inkjet printing system 10 is in a "Rest" mode of operation. At step 102, inkjet printing system 10 gains operational control of a print job. At step 104, service station assembly 20 uncaps and wipes inkjet printhead assembly 12 and, at step 106, paper pick-up mechanism 54 of print media transport assembly 18 pulls print medium 19 into inkjet printing system 10. Steps 104 and 106 both occur during a "Ready" mode of operation of inkjet printing system 10. In addition, service station assembly 20 and paper pick-up mechanism 54 of print media transport assembly 18 are both operated in steps 104 and 106, respectively, by motor 24. While steps 104 and 106 are illustrated as occurring simultaneously, it is within the scope of the present invention for steps 104 and 106 to occur sequentially.

At step 108, carriage 32 of carriage assembly 16 is moved and a print swath is created on print medium 19. Next, at step 110, print medium 19 is advanced by print media transport assembly 18. Thus, steps 108 and 110 are repeated until the print job is completed. Steps 108 and 110 both occur during a "Print" mode of operation of inkjet printing system 10. In addition, carriage assembly 16 and print mode transport assembly 18 are both operated in steps 108 and 110, respectively, by motor 24.

At step 112, service station assembly 20 wipes and caps inkjet printhead assembly 12 and, at step 114, print medium 19 is kicked from inkjet printing system 10 by print media transport assembly 18. Steps 112 and 114 both occur during a "Return-to-Rest" mode of operation of inkjet printing system 10. In addition, service station assembly 20 and print media transport assembly 18 are both operated in steps 112 and 114, respectively, by motor 24. While steps 112 and 114 are illustrated as occurring simultaneously, it is within the scope of the present invention for steps 112 and 114 to occur sequentially.

By selectively coupling motor 24 with carriage assembly 16, print media transport assembly 18, and service station assembly 20, motor 24 can operate functions of each of carriage assembly 16, print media transport assembly 18, and service station assembly 20. Thus, motor 24 can control multiple printing functions of inkjet print system 10, such as moving print carriage 32, advancing print medium 19, and/or maintaining inkjet printhead assembly 12. Thus, by controlling multiple printing functions of inkjet print system 10 with single motor 24, inkjet printing system 10 can be made smaller or made to perform more functions for the same size, may be easier to manufacture, and/or may be less expensive to manufacture.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printing system, comprising:

a print media transport assembly adapted to route a print medium through the inkjet printing system;

a carriage assembly adapted to hold an inkjet printhead assembly and traverse the print medium;

a motor operatively coupled to and adapted to drive both the print media transport assembly and the carriage assembly; and a service station assembly adapted to at least one of wipe, cap, and uncap the inkjet printhead assembly, wherein the motor is operatively coupled to and adapted to drive each of the print media transport assembly, the carriage assembly, and the service station assembly.

2. The inkjet printing system of claim 1, further comprising:

a first power transmission path defined between the motor and the carriage assembly;

a second power transmission path defined between the motor and the print media transport assembly; and a third power transmission path defined between the motor and the service station assembly, wherein the motor is operatively coupled to the carriage assembly via the first power transmission path, operatively coupled to the print media transport assembly via the second power transmission path, and operatively coupled to the service station assembly via the third power transmission path.

3. The inkjet printing system of claim 2, wherein the third power transmission path includes the second power transmission path.

4. The inkjet printing system of claim 1, further comprising:

a first power transmission arrangement interposed between the motor and the carriage assembly, wherein the first power transmission arrangement includes a first coupling configured to selectively connect and disconnect the motor with the carriage assembly.

5. The inkjet printing system of claim 4, further comprising:

a second power transmission arrangement interposed between the motor and the print media transport assembly, wherein the second power transmission arrangement includes a second coupling configured to selectively connect and disconnect the motor with the print media transport assembly.

6. The inkjet printing system of claim 5, wherein the second power transmission arrangement further includes a gear train configured to transfer rotational power of the motor to a rotatable shaft of the print media transport assembly.

7. The inkjet printing system of claim 5, further comprising:

a third power transmission arrangement interposed between the motor and the service station assembly, wherein the third power transmission arrangement includes a third coupling configured to selectively connect and disconnect the motor with the service station assembly.

8. The inkjet printing system of claim 7, wherein the third power transmission arrangement further includes a gear train configured to transfer rotational power of the motor to a movable pallet of the service station assembly.

9. An inkjet printing system, comprising:

a print media transport assembly adapted to route a print medium through the inkjet printing system;

a carriage assembly adapted to hold an inkjet printhead assembly and traverse the print medium;

a motor operatively coupled to and adapted to drive both the print media transport assembly and the carriage assembly; and a first power transmission arrangement interposed between the motor and the carriage assembly, wherein the first power transmission arrangement includes a first coupling configured to selectively connect and disconnect the motor with the carriage assembly.

10. The inkjet printing system of claim 9, wherein the motor is configured to sequentially operate the print media transport assembly and the carriage assembly.

11. The inkjet printing system of claim 9, wherein the motor is adapted to advance the print medium and move the inkjet printhead assembly.

12. The inkjet printing system of claim 11, wherein the motor is adapted to advance the print medium in a first direction and move the inkjet printhead assembly in a second direction, wherein the second direction is substantially perpendicular to the first direction.

13. The inkjet printing system of claim 12, wherein the motor is configured to rotate a portion of the print media transport assembly in the first direction and reciprocate a portion of the carriage assembly in the second direction.

14. The inkjet printing system of claim 9, wherein the print media transport assembly includes a first shaft and at least one roller mounted on the first shaft and wherein the carriage assembly includes a second shaft and a carriage slidably mounted on the second shaft, wherein the at least one roller is adapted to contact the print medium and wherein the carriage is adapted to carry the inkjet printhead assembly.

15. The inkjet printing system of claim 9, further comprising:

a first power transmission path defined between the motor and the carriage assembly; and a second power transmission path defined between the motor and the print media transport assembly, wherein the motor is operatively coupled to the carriage assembly via the first power transmission path and operatively coupled to the print media transport assembly via the second power transmission path.

16. The inkjet printing system of claim 15, further comprising;

a third power transmission path defined between the motor and a service station assembly of the inkjet printing system, wherein the motor is operatively coupled to the service station assembly via the third power transmission path.

17. The inkjet printing system of claim 16, wherein the third power transmission path includes the second power transmission path.

18. The inkjet printing system of claim 9, wherein the first power transmission arrangement further includes a power transmission element configured to transfer rotational power of the motor to a reciprocatable element of the carriage assembly.

19. The inkjet printing system of claim 9, further comprising:

a second power transmission arrangement interposed between the motor and the print media transport assembly, wherein the second power transmission arrangement includes a second coupling configured to selectively connect and disconnect the motor with the print media transport assembly.

20. The inkjet printing system of claim 19, wherein the second power transmission arrangement further includes a gear train configured to transfer rotational power of the motor to a rotatable shaft of the print media transport assembly.

21. The inkjet printing system of claim 19, further comprising:

a third power transmission arrangement interposed between the motor and a service station assembly of the inkjet printing system, wherein the third power transmission arrangement includes a third coupling configured to selectively connect and disconnect the motor with the service station assembly.

22. The inkjet printing system of claim 21, wherein the third power transmission arrangement further includes a gear train configured to transfer rotational power of the motor to a movable pallet of the service station assembly.

23. The inkjet printing system of claim 9, further comprising:

a first sensor adapted to detect a position of the inkjet printhead assembly and generate a first position signal in response thereto;

a second sensor adapted to detect a position of the print medium and generate a second position signal in response thereto; and an electronic controller adapted to receive the first position signal and the second position signal and control at least one of coupling and operation of the motor in response to at least one of the first position signal and the second position signal.

24. A method of printing on a print medium with an inkjet printing system including an inkjet printhead assembly, the method comprising:

routing the print medium through the inkjet printing system via a print media transport assembly; and traversing the print medium with the inkjet printhead assembly via a carriage assembly, wherein routing the print medium and traversing the print medium includes operatively coupling and driving both the print media transport assembly and the carriage assembly with a single motor, wherein operatively coupling the carriage assembly with the single motor includes selectively connecting and disconnecting the single motor with the carriage assembly via a coupling.

25. The method of claim 24, wherein operatively coupling and driving both the print media transport assembly and the carriage assembly includes selectively coupling and sequentially operating the print media transport assembly and the carriage assembly with the single motor.

26. The method of claim 24, wherein routing the print medium and traversing the print medium includes advancing the print medium and moving the inkjet printhead assembly with the single motor.

27. The method of claim 24, wherein advancing the print medium and moving the inkjet printhead assembly includes advancing the print medium in a first direction and moving the inkjet printhead assembly in a second direction, wherein the second direction is substantially perpendicular to the first direction.

28. The method of claim 27, wherein advancing the print medium and moving the inkjet printhead assembly includes rotating a portion of the print media transport assembly in the first direction and reciprocating a portion of the carriage assembly in the second direction.

29. The method of claim 24, further comprising:

detecting a position of the inkjet printhead assembly and generating a first position signal in response thereto;

detecting a position of the print medium and generating a second position signal in response thereto; and controlling at least one of coupling and operation of the single motor in response to at least one of the first position signal and the second position signal.

30. A method of printing on a print medium with an inkjet printing system including an inkjet printhead assembly, the method comprising:

routing the print medium through the inkjet printing system via a print media transport assembly;

traversing the print medium with the inkjet printhead assembly via a carriage assembly; and maintaining a functionality of the inkjet printhead assembly with a service station assembly, wherein routing the print medium, traversing the print medium, and maintaining the functionality of the inkjet printhead assembly includes operatively coupling and driving each of the print media transport assembly, the carriage assembly, and the service station assembly with a single motor.

* * * * *